US006675879B2

(12) United States Patent
Voss

(10) Patent No.: US 6,675,879 B2
(45) Date of Patent: Jan. 13, 2004

(54) COMPACT HEAT EXCHANGER SYSTEM

(75) Inventor: Mark G. Voss, Franksville, WI (US)

(73) Assignee: Modine Manufacturing Company, Racine, WI (US)

( * ) Notice: Subject to any disclaimer, the term of this patent is extended or adjusted under 35 U.S.C. 154(b) by 330 days.

(21) Appl. No.: 09/929,387

(22) Filed: Aug. 14, 2001

(65) Prior Publication Data

US 2002/0033248 A1 Mar. 21, 2002

(30) Foreign Application Priority Data

Sep. 16, 2000 (DE) ..... 100 45 987

(51) Int. Cl.[7] ..... F28F 13/12; F28F 9/26; F28D 7/10; F01P 7/10

(52) U.S. Cl. ..... 165/125; 165/124; 165/144; 165/140; 165/41; 123/41.49

(58) Field of Search ..... 165/41, 121, 122, 165/124, 125, 140, 141, 144, DIG. 314, DIG. 315, DIG. 303; 123/41.12, 41.51

(56) References Cited

U.S. PATENT DOCUMENTS

| | | | | | |
|---|---|---|---|---|---|
| 623,348 | A | * | 4/1899 | Allington | 165/125 |
| 4,062,401 | A | * | 12/1977 | Rudny et al. | 165/122 |
| 4,565,075 | A | * | 1/1986 | Drucker et al. | 165/122 |
| 5,318,110 | A | * | 6/1994 | Wei | 165/145 |
| 5,445,218 | A | * | 8/1995 | Nieh | 165/125 |
| 6,129,056 | A | * | 10/2000 | Skeel et al. | 165/41 |
| 6,145,479 | A | * | 11/2000 | Rotter | 123/41.49 |
| 6,164,909 | A | * | 12/2000 | Ehlers et al. | 165/140 |

FOREIGN PATENT DOCUMENTS

| | | |
|---|---|---|
| DE | 4205234 | 8/1993 |
| DE | 4212070 | 10/1993 |
| DE | 19527050 | 1/1997 |
| DE | 19724728 | 2/1999 |
| EP | 0222636 | 3/1989 |

* cited by examiner

*Primary Examiner*—Henry Bennett
*Assistant Examiner*—Tho V Duong
(74) *Attorney, Agent, or Firm*—Wood, Phillips, Katz, Clark & Mortimer

(57) ABSTRACT

A compact heat exchanger system including a radial fan directing air flow outwardly away from the fan axis and a plurality of heat exchangers disposed around the radial fan. At least two of the heat exchangers include headers with longitudinal walls extending generally in the same direction as the fan axis with one of the heat exchangers disposed with its outlet header longitudinal wall adjacent the longitudinal wall of the inlet header of a second of the heat exchangers. A flow opening is provided between the adjacent longitudinal walls of the outlet header of the one heat exchanger and the inlet header of the second heat exchanger.

19 Claims, 4 Drawing Sheets

COMPACT HEAT EXCHANGER SYSTEM

BACKGROUND OF THE INVENTION

The invention relates to heat exchangers, and more particularly to compact heat exchangers.

Heat exchangers are, in many applications, relatively unconstrained as to the space which they may take up, but in many other applications it is imperative to minimize their size so that they can fit in restricted spaces such as vehicle engine compartments. For example, compact cooling systems are sometimes used in vehicular applications and typically include a plurality of heat exchangers (e.g. radiators), for cooling engine coolant as well as to cool oil, cool turbo or supercharged combustion air and to provide air conditioning to the passenger compartment. Such heat exchangers are sometimes placed together with one another around a radial fan in a box-like configuration. In these and other applications, not only is the size of the heat exchanger important, but the space required for the various connecting lines is also important in minimizing space. Of course, in all instances, cost and ease and reliability of manufacture are important as well.

The present invention is directed toward one or more of the considerations set forth above.

SUMMARY OF THE INVENTION

In accordance with the present invention, a compact heat exchanger system is provided including a radial fan directing air flow radially outwardly away from the fan axis and a plurality of heat exchangers disposed around the radial fan. At least two of the heat exchangers include headers with longitudinal walls extending generally in the same direction as the fan axis with one of the heat exchangers disposed with its outlet header longitudinal wall adjacent the longitudinal wall of the inlet header of a second of the heat exchangers. A flow opening is provided between the adjacent longitudinal walls of the outlet header of the one heat exchanger and the inlet header of the second heat exchanger.

In one form of the invention, the longitudinal walls contact one another.

In another form of the invention, an insert seals the flow opening.

In still another form of the invention, the longitudinal walls of the headers are angled relative to the heat exchanger tubes.

In yet another form of the invention, the longitudinal walls include a space therebetween, and a seal is secured in the space around the flow opening.

In still another form, the plurality of heat exchangers are disposed substantially header to header to define at least a portion of a frame surrounding the radial fan. In another form, the system is a substantially rectangular box with the two heat exchangers each generally defining a respective side of the box.

In yet another form, each of the longitudinal walls includes a corresponding flow opening with an insert, where each of the inserts includes an outwardly extending flange secured to the longitudinal wall in which located and an inwardly extending flange defining a shoulder, with a peripheral member extending around the flow openings and secured between the shoulders of the inserts. In a further form, the peripheral member includes two grooves therearound with seals therein, one seals being disposed against one of the inserts and the other seal disposed against the other of the inserts.

In another form of the invention, the system is substantially box shaped with the first and second heat exchangers defining two adjacent sides of the box, and includes a third heat exchanger generally defining a third side of the box, with the second of the heat exchangers disposed with its outlet header longitudinal wall adjacent the longitudinal wall of the inlet header of the third heat exchanger; and a flow opening between those adjacent longitudinal walls. The above described forms may also be used with this junction of the second and third heat exchangers.

DETAILED DESCRIPTION OF THE INVENTION

Figure 1:
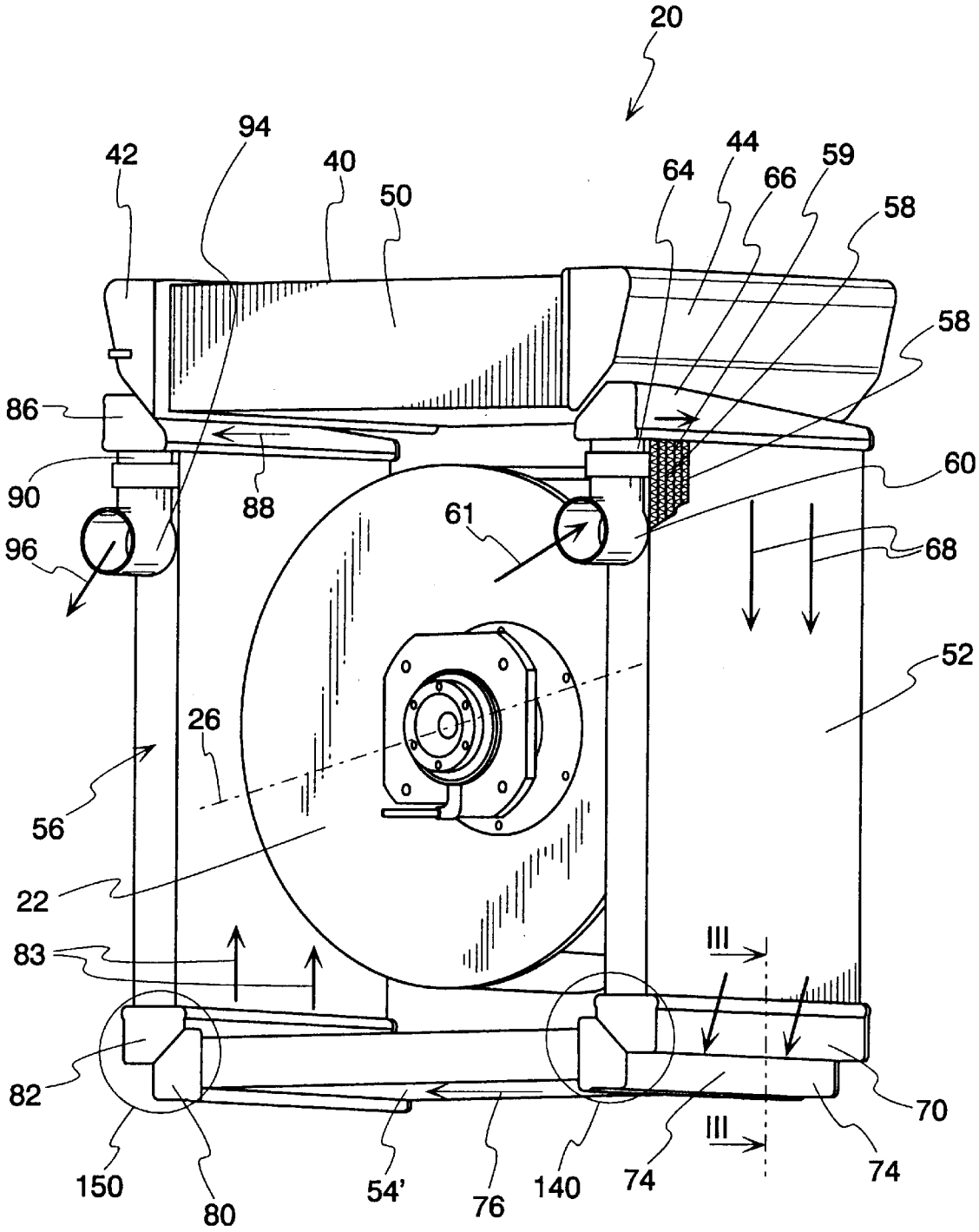
FIG. 1 is a rear perspective view of one embodiment of the compact heat exchanger system of the present invention.

One embodiment of a compact cooling system 20 incorporating heat exchangers according to the present invention is shown in FIG. 1. While reference is made herein to a cooling system, it should nevertheless be understood that the invention could also be used with a compact system providing virtually any type of heat exchange.

The compact cooling system 20 includes a radial fan 22 which rotates about an axis 26 to direct air to flow radially out away from the axis 26. Supported around the fan 22 in the general shape of a rectangular box (though other shapes could be used) are a plurality of heat exchangers. Specifically, in the illustrated embodiment an upper heat exchanger 40 extends across the top which operates independently of the other heat exchangers (i.e., is not supplied from a common fluid source). Specifically, the upper heat exchanger 40 includes a pair of headers 42, 44 48. The upper heat exchanger 40 may be, for example, a conventional charge air cooler for cooling turbocharged or supercharged engine combustion air. Though not shown in the Figures, the upper heat exchanger 40 commonly may include a plurality of suitable tubes extending between the headers 42, 44, with suitable fins extending between the tubes 50 (e.g., serpentine fins or plate fins), whereby the air flow in the upward direction caused by the fan 22 passes over the fins and tubes 50 to cool them and thereby cool the coolant passing through the tubes such as is well known in the art. Such cooling could be one or two phase, that is, a hot fluid (liquid or gas) in the tubes could be cooled (one phase) or a gas such as a refrigerant could be condensed (two phase). It should also be understood that heat transfer in the opposite direction could occur within the scope of the invention (i.e., a hot gas could be passed over the fins and tubes which convey a cool fluid). Most commonly, however, the compact cooling system 20 may be used with vehicles in which the ambient air is used to cool engine fluids.

In the FIG. 1 embodiment, the other three sides of the compact cooling system 20 include three separate heat exchangers 52, 54, 56, each of which may be of generally a similar, generally identical configuration as described for the upper heat exchanger 40 (i.e., with a pair of headers, one with an inlet and the other with an outlet, with tubes 58 extending between the headers and fins 59 between the tubes 58) such as partially illustrated at the upper left of heat exchanger 52 in FIG. 1. (It should also be understood, however, that within the broad scope of the invention it would be possible to use the present invention with multi-pass heat exchangers which, as is understood in the art, have the inlet and outlet in the same headers where there are even numbers of passes.) These three heat exchangers 52, 54, 56 are, in the disclosed embodiment, substantially the same size with substantially the same tube sizes and numbers.

There is a single coolant inlet 60 on the front of the compact cooling system 20. Coolant from whatever the compact cooling system 20 is used with (e.g., a vehicle engine) enters through the inlet 60 (in the direction of arrow 61) and from there is distributed through a short feed line 64 to the inlet header 66 of the heat exchangers 52. Coolant passes from the inlet header 66 through the tubes 58 (in the direction of arrows 68) to the outlet header 70 at the bottom of the right heat exchanger 52. As described in greater detail hereafter, coolant may pass directly from the outlet header 70 to the inlet header 74 of the bottom heat exchanger 54, from which it passes through the tubes of the heat exchanger 54 (in the direction of arrow 76) to its outlet header 80. Coolant may then pass directly from the outlet header 80 to the inlet header 82 of the left heat exchanger 56, from which it passes in the direction of arrows 83 through the tubes of the heat exchanger 56 to its outlet header 84. The coolant then exits the outlet header 84 in the direction of arrow 88 to a short feed (outlet) line 90, through which it passes to the system outlet 94 for outleting in the direction of arrow 96.

Figure 2:
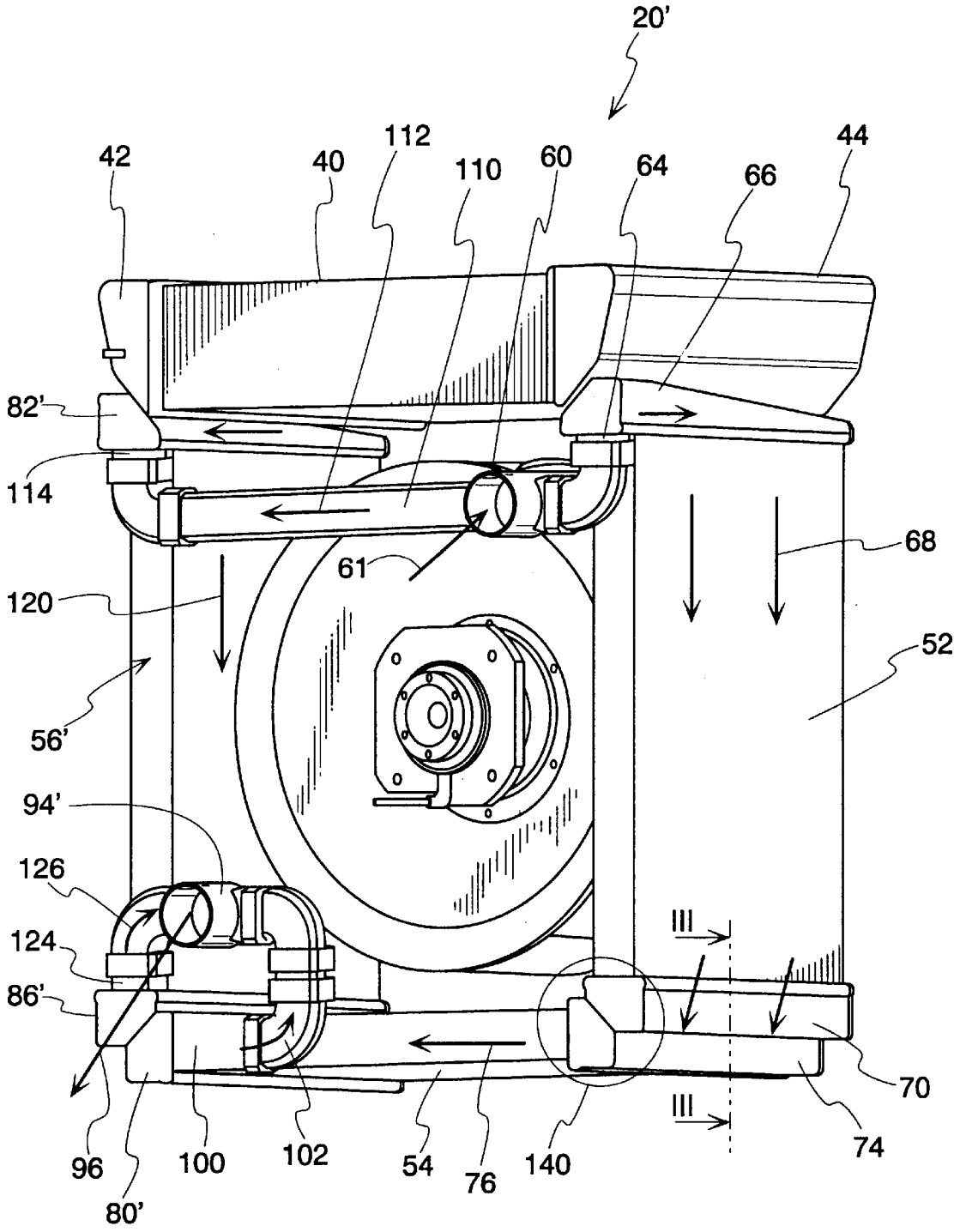
FIG. 2 is a rear perspective view of another embodiment of the compact heat exchanger system of the present invention.

FIG. 2 discloses an alternative embodiment compact cooling system 20' according to the present invention in which only two of the heat exchangers are connected in series (versus the three heat exchangers connected in series in FIG. 1). Specifically, the general configuration of the right and bottom heat exchangers 52, 54' are substantially the same as described in connection with FIG. 1 (and therefore common reference numerals are used for common components) except that the outlet header 80' outlets the coolant to a short feed (outlet) line 100 including a pair of bends 102 to the system outlet 94'.

The left heat exchanger 56' includes a separate feed line 110 so that a portion of the coolant entering through the inlet 60 will pass therethrough in the direction of an arrow 112 to a short feed line 114 at the input to the inlet header 82', from which the coolant will pass down through the tubes of the left heat exchanger 56' in the direction of arrow 120. The coolant exits the tubes of the left heat exchanger 56' into its outlet header 86', from which it passes through a short feed (outlet) line 124 (in the direction of arrow 126) to the system outlet 94'.

Figure 3:
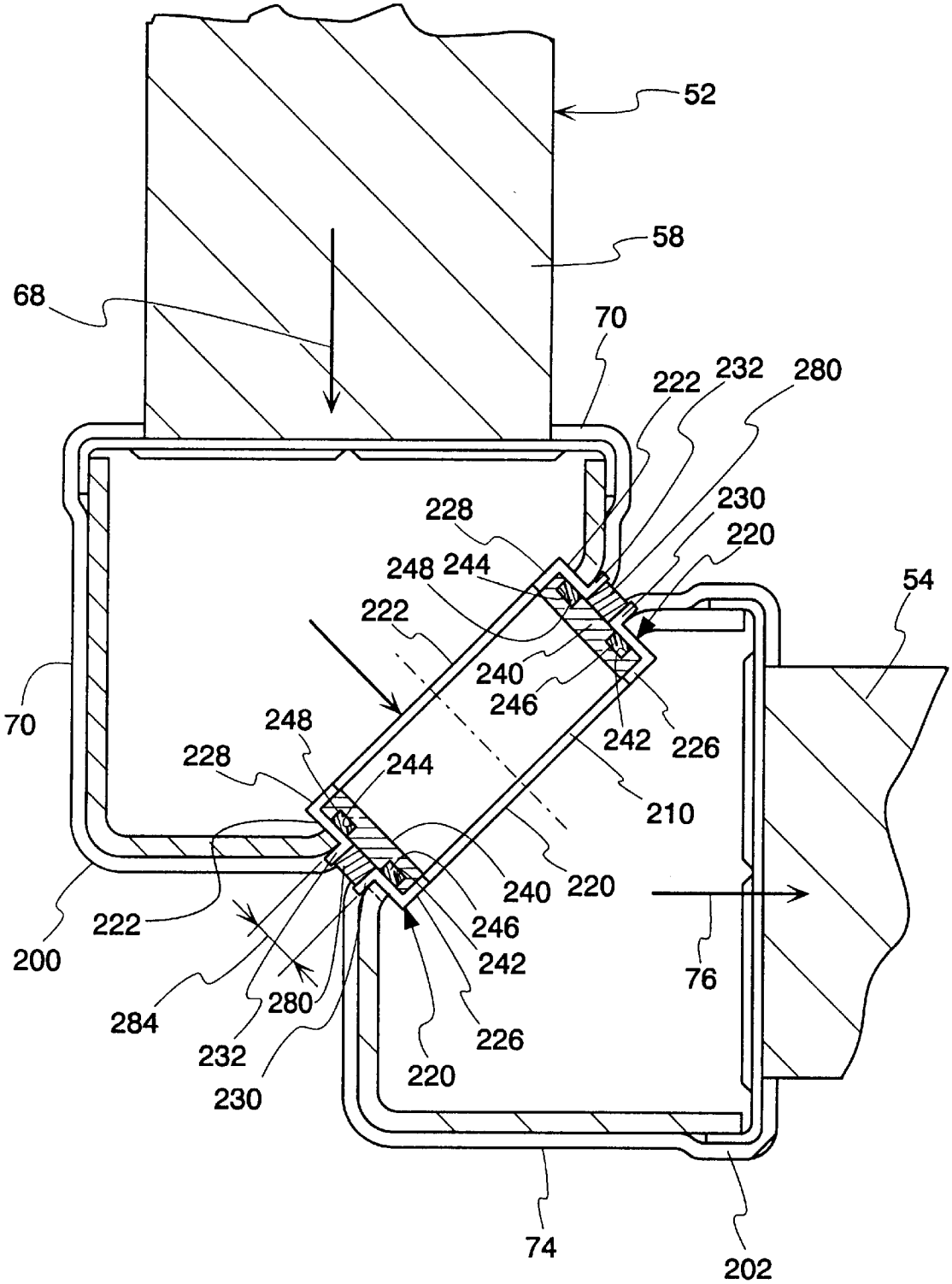
FIG. 3 is a cross-sectional view taken along line III—III of FIG. 1.

The connection of the headers at the bottom corners 140,150 of the FIG. 1 embodiment (and at the bottom right corner 140 of the FIG. 2 embodiment) are illustrated in FIG. 3.

In the illustrated embodiment, the headers 70, 74 include suitably formed walls 200, 202, including facing walls extending longitudinally (generally in the direction of the fan axis 26) and including a flow opening 210 through a portion thereof. Given the right angles between the heat exchangers 52, 54', the facing walls may be at approximately 45 degree angles relative to the direction of the tubes of each heat exchanger 52, 54' such as illustrated to provide for a compact structure. However, it should be understood that other angular relationships of the facing walls could also be used.

An insert 220, 222 is provided in each of the facing walls, which inserts 220, 222 each include an inwardly extending flange 226, 228 forming facing shoulders and an outwardly extending flange 230, 232. The outwardly extending flanges 230, 232 may be conveniently secured in a suitable manner (e.g., soldering) to the facing wall through which it extends to secure the insert 220, 222 around the entire periphery of the flow opening 210. A peripheral member 240 may also be provided between the inserts 220, 222, with a pair of grooves 242, 244 in its outer surface in which are disposed a pair of seals 246, 248 to seal against leakage of the coolant which passes between the headers 70, 74.

An additional seal 280 may also be provided around the flow opening 210 as shown in FIG. 3. This seal 280 is T-shaped in cross-section and is disposed with one leg between the outwardly extending flanges 230, 232 of the inserts 220, 222 and with the other legs between the ends of those flanges 230, 232 and the ends of parts of the facing walls of the headers 70, 74. A space 284 may be provided between the facing walls for this connection structure.

One connection at the flow opening 210 is illustrated in FIG. 3. However, it should be understood that a plurality of such connections could be spaced longitudinally along the facing walls. Further, it should be understood that the flow openings could be in virtually any desired shape, particularly convex shapes such as circles. It should also be appreciated that a similar connection could also be provided between the headers 80, 82 at the other corner 150 of the FIG. 1 embodiment.

It should be appreciated that the above described connection of the headers 70, 74 will provide a secure flow path between the headers 70, 74 such as described overall with respect to the FIG. 1 and FIG. 2 embodiments. Still further, it should be appreciated that this connection will allow for the compact cooling system 20, 20' to be made highly compact so that it may be placed in applications where minimal space requirements are critical. Still further, it should be appreciated that this connection will allow for the compact cooling system 20, 20' to be easily and inexpensively manufactured in a modular fashion, with essentially all of the components of the connection (i.e., inserts 220, 222, peripheral member 240, seals 246, 248, and seal 280) easily assembled from the outside of the headers 70, 74 and then secured therein by assembling the headers 70, 74 together.

It should also be understood that the above described connection at the flow opening between headers 70, 74 is only one example of possible connections, and that there are a virtually limitless number of other connections which could be provided consistent with the overall concept of the invention relating to the compact cooling system 20, 20'. For example, the facing walls could be secured together in contact without the space 284 therebetween, with the connection being suitable to seal against leakage therefrom.

Figure 4:
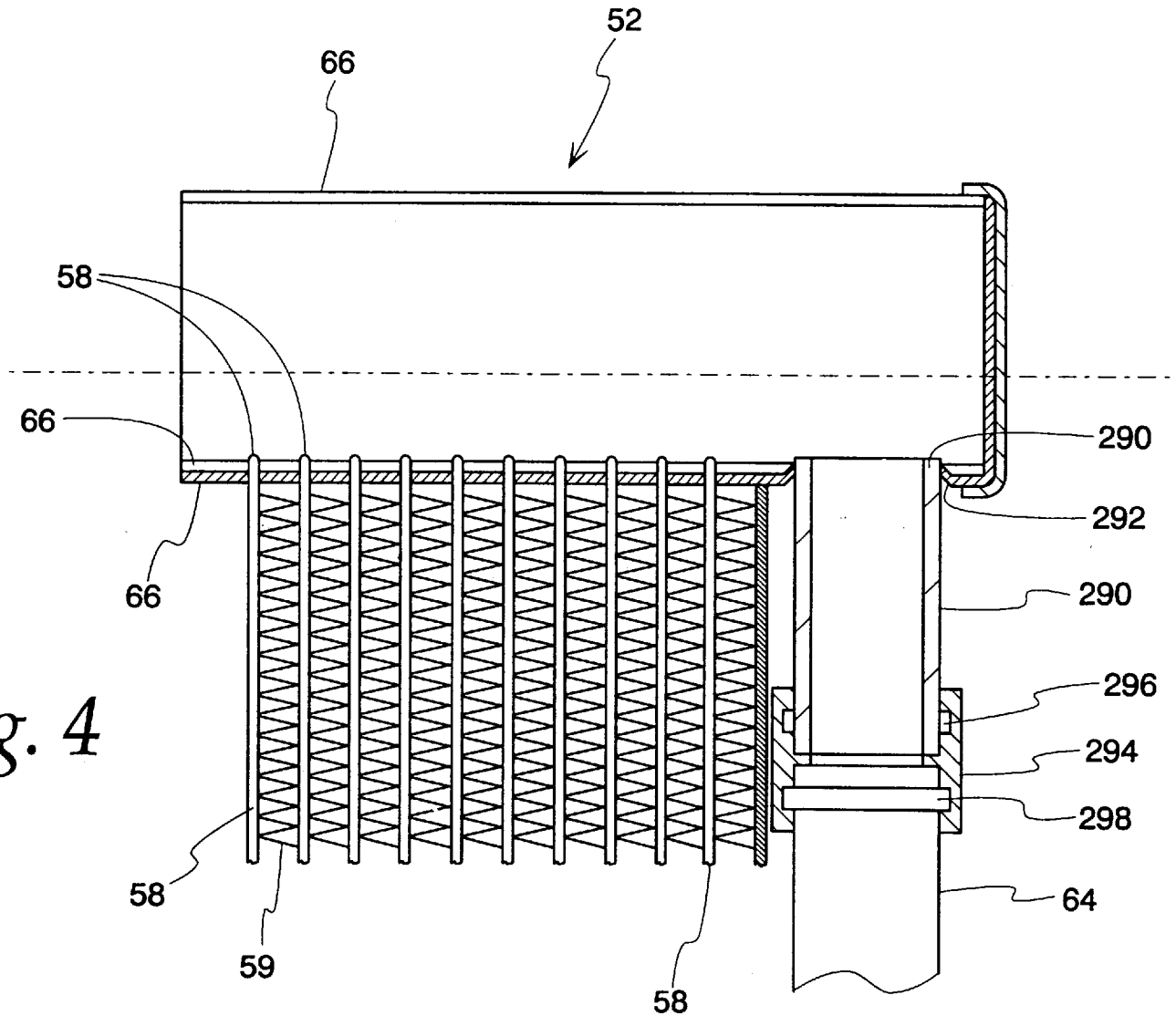
FIG. 4 is a cross-sectional view of a portion of a heat exchanger which may be used with compact heat exchanger systems using the present invention.

FIG. 4 discloses an example of a type of heat exchanger construction which can also be used advantageously with the present invention. The short feed line 64 connecting the inlet 60 to the inlet header 66 of heat exchanger 52 is illustrated in FIG. 4. However, it should be understood that this structure may also be advantageously used for compact connections of all of the feed lines to the headers. As illustrated, the feed line 64 may be suitably secured to a connector 290 suitably secured in a header opening 292 so as to be in parallel with the tubes 58 of the header. Specifically, the feed line 64 is aligned with the end of the connector 290 and secured thereto by a sleeve 294. Seals 296, 298 may also be provided therearound to ensure that there is no leakage through the connection. This heat exchanger structure is the subject matter of the Ehlers et al. application entitled "Compact Heat Exchanger for a Compact System", filed concurrently herewith. The complete disclosure of that application is hereby incorporated by reference.

It should therefore be appreciated that the present invention may be advantageously used to provide inexpensive, easy to manufacture, and flexible construction compact cooling systems.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. A compact heat exchanger system, comprising:

a radial fan having a fan axis, said radial fan directing air flow outwardly away from said fan axis;

a plurality of heat exchangers disposed around said radial fan, each heat exchanger having a plurality of tubes extending between an inlet header and an outlet header, said headers including longitudinal walls extending generally in the same direction as said fan axis with one of said heat exchangers disposed with its outlet header longitudinal wall adjacent the longitudinal wall of the inlet header of a second of said heat exchangers with said plurality of tubes of said one heat exchanger and said second heat exchanger disposed in said air flow; and a flow opening between said adjacent longitudinal walls of said outlet header of said one heat exchanger and said inlet header of said second heat exchanger.

2. The compact heat exchanger system of claim 1, wherein said longitudinal walls contact one another.

3. The compact heat exchanger system of claim 1, further comprising an insert sealing said flow opening whereby fluid flows from said outlet header to said inlet header without leaking therefrom.

4. The compact heat exchanger system of claim 1, wherein said longitudinal walls are angled relative to said plurality of tubes.

5. The compact heat exchanger system of claim 1, wherein said longitudinal walls include a space therebetween, and further comprising a seal secured in said space around said flow opening.

6. The compact heat exchanger system of claim 1, wherein said plurality of heat exchangers are disposed substantially header to header to define at least a portion of a frame surrounding said radial fan.

7. The compact heat exchanger system of claim 1, wherein said system is a substantially rectangular box with said two heat exchangers each generally defining a respective side of said box.

8. The compact heat exchanger system of claim 1, further comprising a system inlet and a system outlet wherein said system inlet receives coolant from a vehicle and discharges coolant to a vehicle from said system outlet.

9. The compact heat exchanger system of claim 1, wherein each of said longitudinal walls includes a corresponding flow opening, and further comprising an insert in each of said openings, each of said inserts including an outwardly extending flange secured to said longitudinal wall in which located and an inwardly extending flange defining a shoulder; and a peripheral member extending around said flow openings and secured between said shoulders of said inserts.

10. The compact heat exchanger system of claim 9, wherein said peripheral member includes two grooves therearound, and further comprising seals in each of said grooves, one seal disposed against one of said inserts and the other seal disposed against the other of said inserts.

11. The compact heat exchanger system of claim 1, wherein said system is substantially box shaped with said first and second heat exchangers defining two adjacent sides of said box, and further comprising:

a third heat exchanger generally defining a third side of said box, said third heat exchanger also having a plurality of tubes extending between an inlet header and an outlet header, said third heat exchanger inlet header also including a longitudinal wall extending generally in the same direction as said fan axis, said second of said heat exchangers disposed with its outlet header longitudinal wall adjacent the longitudinal wall of the inlet header of the third heat exchanger; and a flow opening between said adjacent longitudinal walls of said outlet header of said second heat exchanger and said inlet header of said third heat exchanger.

12. The compact heat exchanger system of claim 11, wherein said longitudinal walls contact one another.

13. The compact heat exchanger system of claim 11, further comprising an insert sealing said flow opening whereby fluid flows from said outlet header to said inlet header without leaking therefrom.

14. The compact heat exchanger system of claim 11, wherein said longitudinal walls are angled relative to said plurality of tubes.

15. The compact heat exchanger system of claim 11, wherein said longitudinal walls include a space therebetween, and further comprising a seal secured in said space around said flow opening.

16. The compact heat exchanger system of claim 11, wherein said plurality of heat exchangers are disposed substantially header to header to define at least a portion of a frame surrounding said radial fan.

17. The compact heat exchanger system of claim 11, wherein said system is a substantially rectangular box with said two heat exchangers each generally defining a respective side of said box.

18. The compact heat exchanger system of claim 11, wherein each of said longitudinal walls includes a corresponding flow opening, and further comprising:

an insert in each of said openings, each of said inserts including an outwardly extending flange secured to said longitudinal wall in which located and an inwardly extending flange defining a shoulder; and a peripheral member extending around said flow openings and secured between said shoulders of said inserts.

19. The compact heat exchanger system of claim 18, wherein said peripheral member includes two grooves therearound, and further comprising seals in each of said grooves, one seal disposed against one of said inserts and the other seal disposed against the other of said inserts.

* * * * *